US008644721B2

(12) United States Patent
Naito

(10) Patent No.: US 8,644,721 B2
(45) Date of Patent: Feb. 4, 2014

(54) IMAGE FORMING APPARATUS

(75) Inventor: Yasutaka Naito, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 228 days.

(21) Appl. No.: 13/154,084

(22) Filed: Jun. 6, 2011

(65) Prior Publication Data

US 2012/0087686 A1 Apr. 12, 2012

(30) Foreign Application Priority Data

Oct. 7, 2010 (JP) ..... 2010-227481

(51) Int. Cl.
*G03G 15/20* (2006.01)

(52) U.S. Cl.
USPC ..... 399/68

(58) Field of Classification Search
USPC ..... 399/68, 70
See application file for complete search history.

(56) References Cited

U.S. PATENT DOCUMENTS

2007/0047991 A1 3/2007 Itoh et al.
2008/0118264 A1* 5/2008 Mori et al. ..... 399/69
2009/0129834 A1* 5/2009 Ito et al. ..... 399/328

FOREIGN PATENT DOCUMENTS

JP 2008-97036 A 4/2008

* cited by examiner

*Primary Examiner* — David Gray
*Assistant Examiner* — Sevan A Aydin
(74) *Attorney, Agent, or Firm* — Sughrue Mion, PLLC

(57) ABSTRACT

An image forming apparatus includes an image forming unit; a fixing unit that heats a recording medium and fixes the image on the recording medium; a pressure member that is rotatable and has an outer peripheral surface, the pressure member moving from a position separated from the fixing unit to a position in contact with the fixing unit, the pressure member pressing the recording medium when the recording medium enters a contact section between the fixing unit and the outer peripheral surface; and a controller that controls transportation of the recording medium and a time at which a region of the outer peripheral surface reaches the contact section, the region contacting the fixing unit when the fixing unit contacts the outer peripheral surface and repeatedly reaching the contact section, so that the recording medium enters the contact section when the region reaches the contact section as the pressure member rotates.

10 Claims, 12 Drawing Sheets

IMAGE FORMING APPARATUS

CROSS-REFERENCE TO RELATED APPLICATIONS

This application is based on and claims priority under 35 USC 119 from Japanese Patent Application No. 2010-227481 filed Oct. 7, 2010.

BACKGROUND

1. Technical Field

The present invention relates to an image forming apparatus.

2. Summary

According to an aspect of the invention, an image forming apparatus includes an image forming unit that forms an image on a recording medium; a fixing unit that heats the recording medium transported from the image forming unit and fixes the image on the recording medium; a pressure member that is rotatable and has an outer peripheral surface, the pressure member moving relative to the fixing unit from a position at which the pressure member is separated from the fixing unit to a position at which the outer peripheral surface contacts the fixing unit, the pressure member pressing the recording medium while rotating when the recording medium enters a contact section between the fixing unit and the outer peripheral surface; and a controller that controls transportation of the recording medium and a time at which a region of the outer peripheral surface reaches the contact section, the region contacting the fixing unit when the fixing unit contacts the outer peripheral surface and repeatedly reaching the contact section as the pressure member rotates, so that the recording medium that has been transported enters the contact section when the region reaches the contact section as the pressure member rotates.

BRIEF DESCRIPTION OF THE DRAWINGS

An exemplary embodiment of the present invention will be described in detail based on the following figures, wherein.

DETAILED DESCRIPTION

Hereinafter, an exemplary embodiment of the present invention will be described with reference to the drawings.

Figure 1:
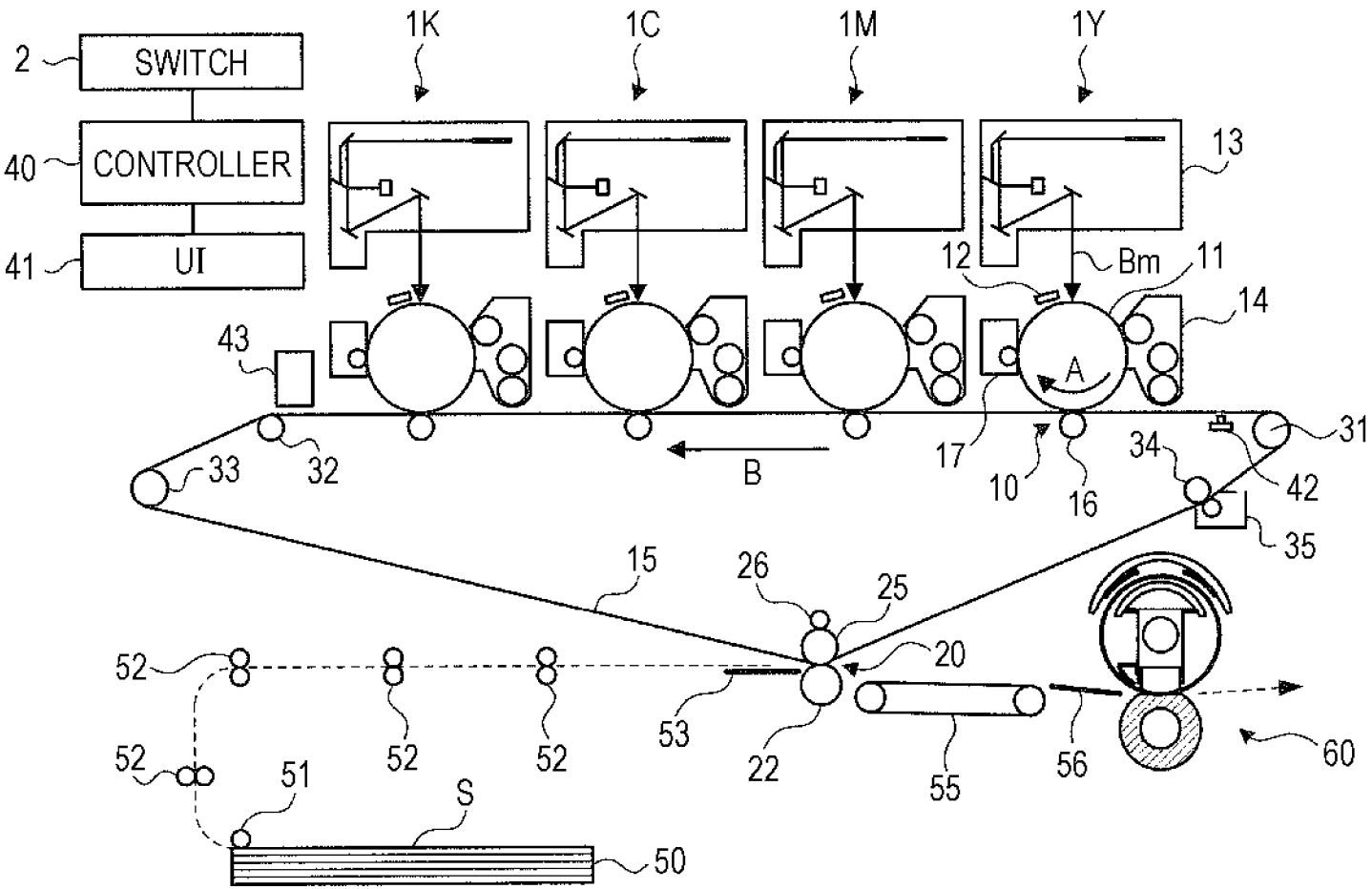
FIG. 1 is a schematic view of an image forming apparatus according to the exemplary embodiment.

FIG. 1 is a schematic view of an image forming apparatus according to the exemplary embodiment. The image forming apparatus illustrated in FIG. 1 is of a tandem-type and intermediate transfer type. The image forming apparatus includes plural image forming units 1Y, 1M, 1C, and 1K; and first transfer sections 10. The image forming units 1Y, 1M, 1C, and 1K respectively form color images by using an electrophotographic method. The first transfer sections 10 successively transfer (first-transfer) the color toner images formed by the image forming units 1Y, 1M, 1C, and 1K to an intermediate transfer belt 15. The image forming apparatus includes a second transfer section 20 and a fixing unit 60. The second transfer section 20 simultaneously transfers (second-transfers) the toner images (unfixed toner image), which have been transferred to the intermediate transfer belt 15, to a sheet S. The fixing unit 60 fixes the toner images on the sheet S. The image forming apparatus includes a controller 40 for controlling the operation of each unit (section), a user interface (UI) 41 for receiving a command from a user, and a switch 2 for turning on and off the power of the image forming apparatus. The image forming units 1Y, 1M, 1C, and 1K, the intermediate transfer belt 15, the first transfer sections 10, the second transfer sections 20, etc., are collectively an example of an image forming unit that forms an image on the sheet S, which is an example of a recording medium.

Each of the image forming units 1Y, 1M, 1C, and 1K includes a photoconductor drum 11 that rotates in the direction of arrow A, a charger 12 for charging the photoconductor drum 11, and a laser exposure device 13 for forming an electrostatic latent image on the photoconductor drum 11 (an expose light beam is denoted by a numeral Bm in FIG. 1). Each of the image forming units 1Y, 1M, 1C, and 1K includes a developing unit 14, a first transfer roller 16, and a drum cleaner 17. The developing unit 14 contains a color toner and makes an electrostatic latent image on the photoconductor drum 11 visible by using the color toner. The first transfer roller 16 transfers the color toner image formed on the photoconductor drum 11 to the intermediate transfer belt 15 in the first transfer section 10. The drum cleaner 17 removes remaining toner from the photoconductor drum 11. The image forming units 1Y, 1M, 1C, and 1K are substantially linearly arranged in the order of yellow (Y), magenta (M), cyan C, and black (K) in the direction in which the intermediate transfer belt 15 moves.

The intermediate transfer belt 15 is an endless belt made of a film-like resin material, such as a polyimide resin or a polyamide resin, including an antistatic agent such as carbon black. The intermediate transfer belt 15 has a volume resistivity in the range of $10^6$ to $10^{14}$ Ωcm and has a thickness of, for example, about 0.1 mm. The intermediate transfer belt 15 is rotated by rollers in the direction of arrow B of FIG. 1 at a predetermined speed. The rollers include a driving roller 31, a support roller 32, a tension roller 33, a backup roller 25, and a cleaning backup roller 34. The driving roller 31 is driven by a motor (not shown) having a stable speed characteristics and rotates the intermediate transfer belt 15. The support roller 32 supports the intermediate transfer belt 15, which extends substantially linearly in the direction in which the photoconductor drums 11 are arranged. The tension roller 33 applies a tension to the intermediate transfer belt 15 and also functions as a correction roller for preventing oblique movement of the intermediate transfer belt 15. The backup roller 25 is disposed in the second transfer section 20. The cleaning backup roller 34 is disposed in a cleaning section for removing remaining toner from the intermediate transfer belt 15.

The first transfer section 10 includes the first transfer roller 16, which is disposed so as to face the photoconductor drum 11 with the intermediate transfer belt 15 therebetween. The first transfer roller 16 is pressed against the photoconductor drum 11 with the intermediate transfer belt 15 therebetween. A voltage (first transfer bias) having a polarity opposite to the polarity of the charge of the toner (hereinafter assumed to be a negative charge) is applied to the first transfer roller 16. Thus, toner images on the photoconductor drums 11 are successively attracted and transferred to the intermediate transfer belt 15, and thereby a multi-layered toner image is formed on the intermediate transfer belt 15.

The second transfer section 20 includes the second transfer roller 22 and a backup roller 25. The second transfer roller 22 is disposed so as to face a side of the intermediate transfer belt 15 on which the toner image is formed. The backup roller 25 has a tubular surface, which is made of a blend of EPDM rubber and NBR rubber dispersed with carbon, and a body made of EPDM rubber. The backup roller 25 is disposed so as to face the back side of the intermediate transfer belt 15 and serves as an electrode opposite to the second transfer roller 22. A power feed roller 26, which is made of a metal and to which a second transfer bias is stably applied, is disposed so as to contact the backup roller 25. The second transfer roller 22 has a shaft and a sponge layer, which is an elastic layer bonded around the shaft. The second transfer roller 22 is pressed against the backup roller 25 with the intermediate transfer belt 15 therebetween. The second transfer bias is applied between the second transfer roller 22, which is grounded, and the backup roller 25, whereby the toner image is second-transferred to the sheet S in the second transfer section 20.

An intermediate transfer belt cleaner 35 is disposed downstream of the second transfer section 20 so as to be contactable with the intermediate transfer belt 15. The intermediate transfer belt cleaner 35 cleans the surface of the intermediate transfer belt 15 by removing remaining toner and paper dust from the surface of the intermediate transfer belt 15 after the second transfer has been finished. A reference sensor (home position sensor) 42 is disposed upstream of the image forming unit for yellow. The reference sensor 42 generates a reference signal for adjusting image formation timings of the image forming units 1Y, 1M, 1C, and 1K. An image density sensor 43 is disposed downstream of the image forming unit 1K for black. The reference sensor 42 generates the reference signal by detecting a mark provided on the back side of the intermediate transfer belt 15. The controller 40 issues a command on the basis of the reference signal, and each of the image forming units 1Y, 1M, 1C, and 1K starts an image forming operation.

The image forming apparatus according to the present exemplary embodiment has a sheet transport system including a sheet container 50, a pick-up roller 51, a transport roller 52, a transport chute 53, a transfer belt 55, and an entrance guide 56. The sheet container 50 contains the sheet S. The pick-up roller 51 picks up the sheet S, which is contained in the sheet container 50, at a predetermined timing and feeds the sheet S. The transport roller 52 transports the sheet S, which has been fed by the pick-up roller 51. The transport chute 53 guides the sheet S, which has been transferred by the transport roller 52, into the second transfer section 20. The transfer belt 55 transports the sheet S, on which the second transfer roller 22 has second-transferred the toner image, to the fixing unit 60. The entrance guide 56 guides the sheet S to the fixing unit 60.

A process of forming an image according to the present exemplary embodiment will be described. Image data is output from an image reading apparatus (not shown), a personal computer (PC) (not shown), or the like (not shown). In the image forming apparatus illustrated in FIG. 1, an image processing unit performs predetermined image processing on the image data, and then each of the image forming units 1Y, 1M, 1C, and 1K perform an image forming operation. The image processing unit performs various image processing operations, such as shading correction using reflectivity data that is input, displacement correction, conversion/color space conversion, gamma correction, cropping and color adjustment, and movement correction. The processed image data is converted to color gradation data for Y, M, C, and K, and the converted image data is output to the laser exposure devices 13.

In accordance with the input color gradation data, the laser exposure devices 13 irradiate the photoconductor drums 11 of the image forming units 1Y, 1M, 1C, 1K with light beams Bm emitted by, for example, semiconductor lasers. The chargers 12 charge the surfaces of the photoconductor drums 11 of the image forming units 1Y, 1M, 1C, and 1K, and the laser exposure devices 13 scan and expose the surfaces with the light beams Bm, whereby electrostatic latent images are formed on the surfaces. The image forming units 1Y, 1M, 1C, and 1K develop the electrostatic latent images, thereby forming color toner images for Y, M, C, and K.

The toner images, which have been formed on the photoconductor drums 11 of the image forming units 1Y, 1M, 1C, and 1K, are transferred to the intermediate transfer belt 15 in the first transfer sections 10, in which the photoconductor drums 11 contact the intermediate transfer belt 15. To be specific, in the first transfer sections 10, the first transfer rollers 16 each apply a voltage (first transfer bias) having a polarity (negative polarity) opposite to that of the toner to a base member of the intermediate transfer belt 15, and the toner images are successively transferred to the surface of the intermediate transfer belt 15.

After the toner images have been transferred to the surface of the intermediate transfer belt 15, the toner images are transported to the second transfer section 20 as the intermediate transfer belt 15 rotates. When the toner images are transported to the second transfer section 20, the pick-up roller 51 starts rotating in the sheet transport system to feed the sheet S from the sheet container 50. The sheet S, which has been fed by the pick-up roller 51, is transported to the transport roller 52, guided by the transport chute 53, and reaches the second transfer section 20. Before reaching the second transfer section 20, the sheet S is temporarily stopped. At an appropriate timing relative to the movement of the intermediate transfer belt 15, which carries the toner images thereon, a registration roller (not shown) starts rotating and transportation of the sheet S is restarted. Thus, the relative positions of the sheet S and the toner images are adjusted.

In the second transfer section 20, the second transfer roller 22 is pressed against the backup roller 25 with the intermediate transfer belt 15 therebetween. At this time, the sheet S, which has been transported at an appropriate timing, is nipped between the intermediate transfer belt 15 and the second transfer roller 22. When the power feed roller 26 applies a voltage (second transfer bias) having a polarity the same as that of the toner is applied to the backup roller 25, a transfer electric field is generated between the second transfer roller 22 and the backup roller 25. Then, the unfixed toner images on the intermediate transfer belt 15 are simultaneously and electrostatically transferred to the sheet S in the second transfer section 20, which is formed by the second transfer roller 22 and the backup roller 25.

Subsequently, the sheet S, to which the toner images have been electrostatically transferred, is peeled off the intermediate transfer belt 15 by the second transfer roller 22 and transported to the transfer belt 55, which is disposed downstream of the second transfer roller 22 in the sheet transport direction. The transfer belt 55 transports the sheet S to the fixing unit 60 in accordance with the speed with which the sheet S is transported in the fixing unit 60. The fixing unit 60 heats and presses the unfixed toner images on the sheet S, which have been transported to the fixing unit 60, thereby fixing the toner images on the sheet S. The sheet S, on which a fixed image is formed, is transported to an output sheet stacker (not shown) provided in an output section of the image forming apparatus. After the toner images have been transferred to the sheet S, remaining toner, which remains on the intermediate transfer belt 15, is transported to the cleaning section as the intermediate transfer belt 15 rotates. The cleaning backup roller 34 and the intermediate transfer belt cleaner 35 remove the remaining toner from the intermediate transfer belt 15.

Next, the fixing unit 60 will be described in detail.

Figure 2:
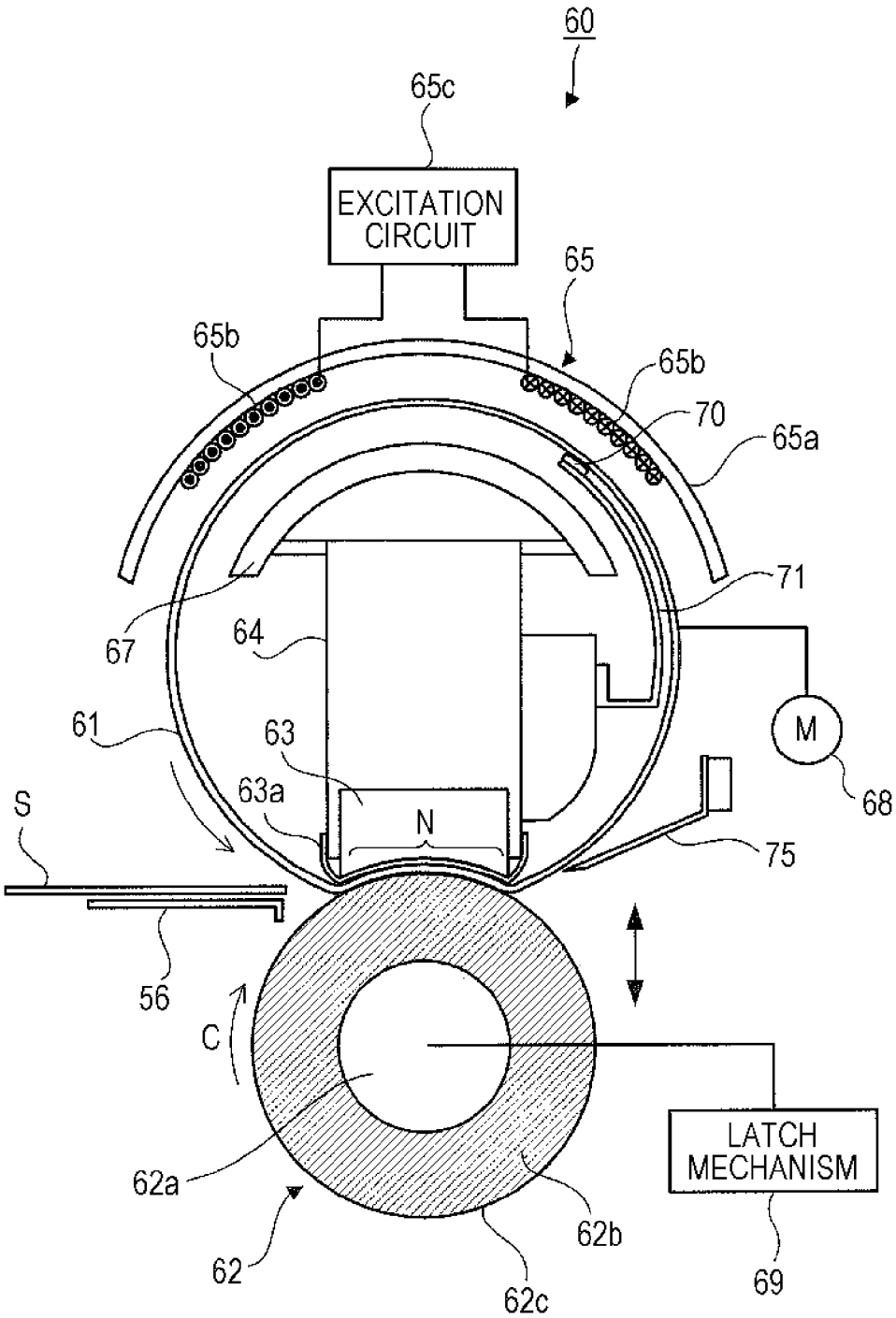
FIG. 2 is a schematic view of a fixing unit.

FIG. 2 is a schematic view of the fixing unit 60.

As illustrated in FIG. 2, the fixing unit 60 includes a fixing belt 61, a pressure roller 62, a pressure pad 63, a pad support member 64, an induction heater 65, a ferrite member 67, and a driving motor 68. The fixing belt 61 (which is an example of a fixing unit) is an endless belt that is rotatable. The pressure roller 62 is rotatable and in contact with the outer peripheral surface of the fixing belt 61. The pressure pad 63 is disposed inside the fixing belt 61 and pressed against the pressure roller 62 with the fixing belt 61 therebetween. The pad support member 64 supports the pressure pad 63 and the like. The induction heater 65 has a shape corresponding to the outer peripheral surface of the fixing belt 61, is disposed so as to face the fixing belt 61 with a space therebetween, and heats the fixing belt 61 by electromagnetic induction along the length of the fixing belt 61. The ferrite member 67 is disposed inside the fixing belt 61 along the inner peripheral surface of the fixing belt 61 and increases the heating efficiency of the fixing belt 61. The driving motor 68 drives the fixing belt 61.

In the fixing unit 60 according to the present exemplary embodiment, the fixing belt 61 is rotated at a predetermined speed, and the pressure roller 62 is rotated by the fixing belt 61 in the direction of arrow C of FIG. 2 at a predetermined speed in accordance with the rotation of the fixing belt 61. In other words, the pressure roller 62 receives a rotational force from the fixing belt 61 and rotates together with the fixing belt 61. The pressure roller 62 extends parallel to the rotation axis of the fixing belt 61. Both ends of the pressure roller 62 are urged toward the fixing belt 61 by spring members (not shown). In the present exemplary embodiment, the pressure roller 62 is pressed against the pressure pad 63 by a force of 294 N (30 kgf) with the fixing belt 61 therebetween.

In the fixing unit 60 according to the present exemplary embodiment, the pressure roller 62 is separatable from the fixing belt 61. To be specific, in the fixing unit 60 according to the present exemplary embodiment, the position of the fixing belt 61 is fixed in place, and the pressure roller 62 is moved by a latch mechanism 69 so as to be in contact with and separated from the fixing belt 61. The latch mechanism 69 is a combination of, for example, a motor, an eccentric cam, etc. To be specific, for example, the pressure roller 62 may be separated from the fixing belt 61 by rotating the eccentric cam in a certain direction and displacing the rotation axis (not shown) of the pressure roller 62 by using the eccentric cam. When the eccentric cam is rotated in the opposite direction, the pressure roller 62 approaches the fixing belt 61 and the pressure roller 62 contacts the fixing belt 61.

Figure 3A:
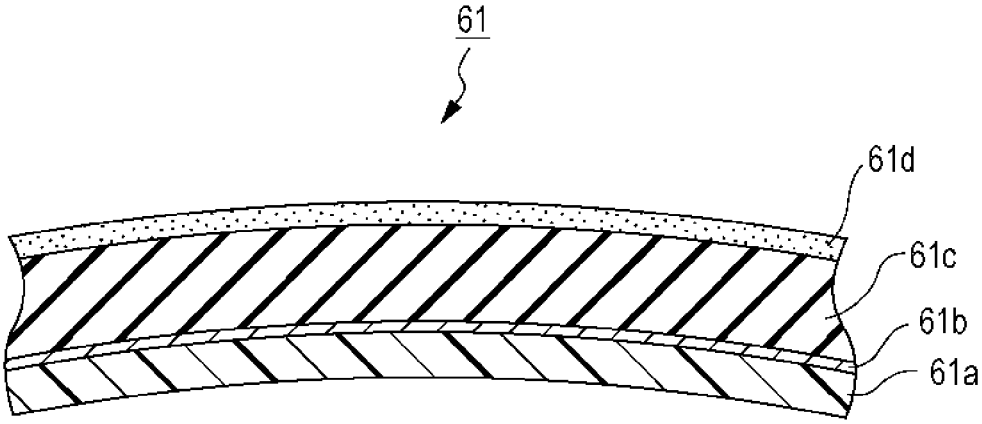
FIGS. 3A and 3B illustrate the structure of a fixing belt.

FIG. 3A illustrates the structure of the fixing belt 61. The fixing belt 61 includes, from the inner side, a base layer 61*a* made of a heat-resistant sheet, an electroconductive layer 61*b*, an elastic layer 61*c*, and a surface release layer 61*d* that forms the outer peripheral surface.

As the base layer 61*a*, a flexible, mechanically strong, and heat-resistant material is used. Examples of such a material are a fluorocarbon resin, a polyimide resin, a polyamide resin, a polyamide-imide resin, a PEEK resin, a PES resin, a PPS resin, a PFA resin, a PTFE resin, and an FEP resin. The thickness of the base layer 61*a* is in the range of 10 to 150 μm or may be in the range of 30 to 100 μm. If the thickness of the base layer 61*a* is smaller than 10 μm, the strength of the fixing belt 61 is insufficient. If the thickness of the base layer 61*a* is larger than 150 μm, the fixing belt 61 has a low flexibility and a high heat capacity so that it takes more time to increase the temperature of the fixing belt 61. In the present exemplary embodiment, a polyimide sheet having a thickness of 80 μm is used.

The electroconductive layer 61*b* is a layer that generates heat by induction due to a magnetic field induced by the induction heater 65. The electroconductive layer 61*b* is made of a metal, such as iron, cobalt, nickel, copper, aluminum, or chrome, and has a thickness in the range of about 1 to 80 μm. The material and the thickness of the electroconductive layer 61*b* are determined so that the electroconductive layer 61*b* may have a sufficient resistivity to enable an eddy current generated by electromagnetic induction to generate sufficient heat. In the present exemplary embodiment, a copper layer having a thickness of about 10 μl is used.

The thickness of the elastic layer 61*c* is in the range of 10 to 500 μm or may be in the range of 50 to 300 μm. The material of the elastic layer 61*c* is a heat-resistant and heat-conductive material, such as a silicone rubber, a fluorocarbon rubber, or a fluorosilicone rubber. In the present exemplary embodiment, a silicone rubber having a hardness of 15° (measured by using a JIS-A:JIS-K A-type test machine) and a thickness of 200 μm.

The surface release layer 61*d* directly contacts an unfixed toner image that has been transferred to the sheet S. Therefore, it is necessary that the surface release layer 61*d* have a good releasability and a high heat resistance. As the material of the surface release layer 61*d*, for example, polytetrafluoroethylene perfluoroalkylvinylether (PFA), polytetrafluoroethylene (PTFE), a fluorocarbon resin, a silicone resin, a fluorosilicone rubber, a fluorocarbon rubber, a silicone rubber, or the like may be used.

Figure 3B:
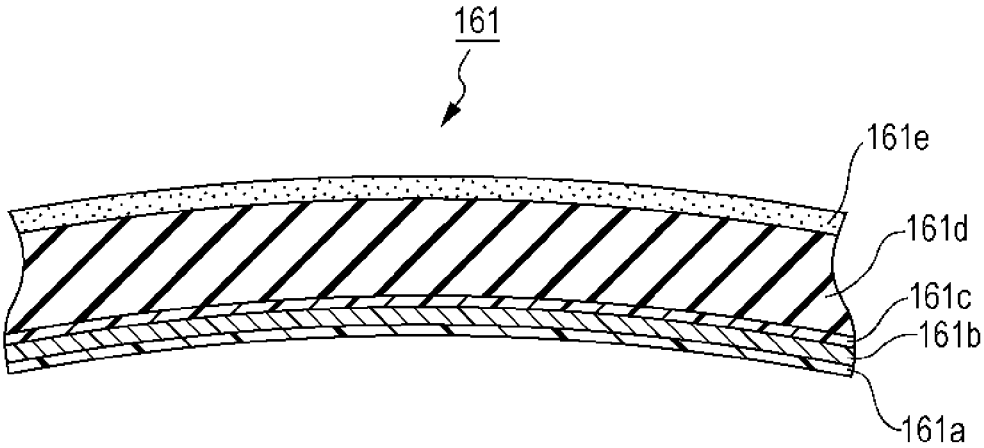

Instead of the fixing belt 61 described above, a fixing belt 161 illustrated in FIG. 3B may be used. The fixing belt 161 includes heat-resistant resin layers 161*a* and 161*c* that sandwich an electroconductive layer 161*b* therebetween. An elastic layer 161*d* and a surface release layer 161*e* are stacked on the front side. In this case, even if the thickness of the electroconductive layer 161*b*, which is made of a metal, is small, the fixing belt 161 is resistant to repeated bending. The material of the heat-resistant resin layers 161*a* and 161*c* is not limited to a heat-resistant resin.

Referring to FIG. 2, the pressure roller 62 includes a cylindrical member 62*a*, which is a metal core. An elastic layer 62*b* is provided on the surface of the cylindrical member 62*a*. The elastic layer 62*b* is made of a heat-resistant material, such as a silicone rubber, a silicone rubber foam, a fluorocarbon rubber, or a fluorocarbon resin. A surface release layer 62*c* is provided on the outer surface of the pressure roller 62.

The pressure pad 63 is made of an elastic material, such as a silicone rubber or a fluorocarbon rubber, or made of a heat-resistant resin, such as a polyimide resin, polyphenylene sulfide (PPS), polyether sulfone (PES), or a liquid-crystal polymer (LCP). The pressure pad 63 extends along the width of the fixing belt 61 over a region that is slightly larger than a region that the sheet S passes (sheet-passing region), so that the pressure roller 62 may be pressed against the pressure pad 63 over substantially the entire length of the pressure pad 63. The contact surface between the pressure pad 63 and the fixing belt 61 is a convex curved surface having a shape corresponding to the outer surface of the pressure roller 62. As a result, the nip width of the pressure pad 63 against the pressure roller 62 is sufficiently large.

A sliding sheet 63*a* is disposed between the pressure pad 63 and the fixing belt 61 in order to reduce friction between the pressure pad 63 and the fixing belt 61 in a fixing nip N. The sliding sheet 63*a* is made of a material having a low friction and a high wear resistance, such as a polyimide film or a glass fiber sheet impregnated with a fluorocarbon resin. Moreover, a lubricant is applied to the inner peripheral surface of the fixing belt 61. As the lubricant, an amino-modified silicone oil, a dimethyl silicone oil, or the like may be used. Thus, friction between the fixing belt 61 and the pressure pad 63 is reduced, whereby the fixing belt 61 rotates smoothly.

The pad support member 64 is a bar-shaped member having an axis extending along the width of the fixing belt 61. The pressure pad 63 is attached to a part of the pad support member 64 that faces the pressure roller 62, and the pad support member 64 receives a pressing force applied by the pressure roller 62 toward the pressure pad 63. Therefore, as the material of the pad support member 64, a material having a rigidity such that deflection that occurs when the pad support member 64 receives the pressing force from the pressure roller 62 is smaller than a predetermined level, which is, for example, equal to or smaller than 1 mm. Moreover, as described below, it is necessary that the pad support member 64 be not easily heated by an influence of the induction heater 65. Therefore, as the material of the pad support member 64, a heat-resistant resin, such as a glass-fiber-filled PPS, a phenol resin, a polyimide resin, a liquid-crystal polymer, a heat-resistant glass, or a metal having a metal that has a low resistivity and that is not responsive to induction heating, such as aluminum or the like, is used.

The ferrite member 67 and a thermistor 70 are fixed to the pad support member 64. The ferrite member 67 is made of a material having a high magnetic permeability (a ferrite, a permalloy, or the like) so that the induction heater 65 may efficiently heat the fixing belt 61. The thermistor 70, which detects the temperature of the fixing belt 61, is fixed to the pad support member 64 by a spring member 71. The thermistor 70 is pressed against the inner peripheral surface of the fixing belt 61. In the present exemplary embodiment, the thermistor 70 is disposed in a middle portion of the fixing belt 61 in the longitudinal direction, and another thermistor (not shown) is disposed at one end of the fixing belt 61. A thermoswitch (not shown) is provided on the pad support member 64 at a position adjacent to the fixing belt 61. Instead of or in addition to the thermistor 70 (and the other thermistor), which detects the temperature of the fixing belt 61, a thermistor that detects the surface temperature of the pressure roller 62 may be provided.

Figure 4:
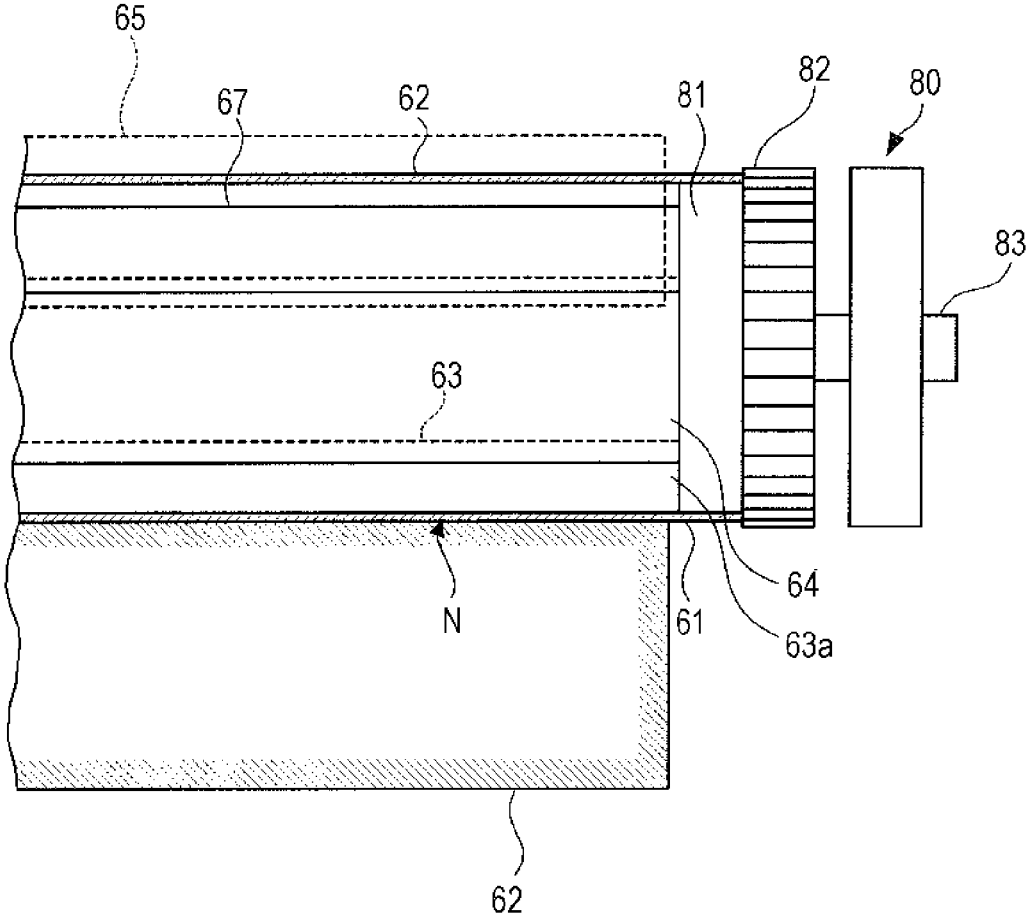
FIG. 4 is a partial view of an end portion of the fixing unit seen from an upstream side in the sheet transport direction, illustrating how the fixing belt is supported by a rotation guide.

Rotation guides 80 (see FIG. 4) are disposed at ends of the pad support member 64 in the axial direction. The rotation guides 80 support the fixing belt 61, receive a driving force from the driving motor 68 (see FIG. 2), and rotate the fixing belt 61 by using the driving force. Both ends of the inner peripheral surface of the fixing belt 61 are supported by the rotation guides 80, whereby the fixing belt 61 maintains a predetermined shape (for example, a substantially circular shape) while rotating. FIG. 4 is a partial view of an end portion of the fixing unit 60 seen from an upstream side in the direction in which the sheet S is transported, illustrating how the fixing belt 61 is supported by one of the rotation guides 80.

As illustrated in FIG. 4, the rotation guide 80 includes an end cap 81, a drive gear 82, and a rotary shaft 83. The end cap 81 is inserted into an end portion of the fixing belt 61 and supports the fixing belt 61. The drive gear 82 is integrally formed with the end cap 81 and disposed on the outer side of the end cap 81 in the axial direction of the fixing belt 61. The rotary shaft 83 is integrally formed with the pad support member 64 and rotatably supports the end cap 81 and the drive gear 82. In the present exemplary embodiment, when a rotational driving force is applied from the driving motor 68 (see FIG. 2) to the drive gear 82, the end cap 81 and the drive gear 82 rotate around the rotary shaft 83. Then, the fixing belt 61 is rotated by the end cap 81 and the drive gear 82. When the outer peripheral surface of the pressure roller 62 is in contact with the fixing belt 61 due to the latch mechanism 69, the pressure roller 62 is rotated by the fixing belt 61.

Next, the induction heater 65 will be described. As illustrated in FIG. 2, the induction heater 65 includes a base 65*a*, an excitation coil 65*b*, and an excitation circuit 65*c*. The base 65*a* extends along the width of the fixing belt 61 and has a curved inner surface facing the fixing belt 61 and having a shape corresponding to the shape of the fixing belt 61. The excitation coil 65*b* is supported by the base 65*a*. The excitation circuit 65*c* supplies a high-frequency current to the excitation coil 65*b*.

The material of the base 65*a* is an insulating and heat-resistant material, such as a phenol resin, a polyimide resin, a polyamide resin, a polyamide-imide resin, or a liquid-crystal polymer. The excitation coil 65*b* is, for example, a coil made by winding a Litz wire, which includes plural copper strands each having a diameter in the range of 0.1 to 0.5 mm and coated with a heat-resistant insulating material (such as a polyimide resin, a polyamide-imide resin, or the like). The coil has plural (for example, eleven) closed loops having an elongated circular, an elliptical, or a rectangular shape. The excitation coil 65*b* is made solid by an adhesive and fixed to the base 65*a* while maintaining the coiled shape. The distance between the excitation coil 65*b* and the electroconductive layer 61*b* of the fixing belt 61 and the distance between the ferrite member 67 and the electroconductive layer 61*b* are set equal to or smaller than 5 mm (for example, about 2.5 mm), because smaller the distances, the higher the efficiency in absorbing magnetic flux.

In the induction heater 65, when the excitation circuit 65*c* supplies a high-frequency current to the excitation coil 65*b*, magnetic flux is repeatedly generated and dissipated around the excitation coil 65*b*. The frequency of the high-frequency current is in the range of 20 to 100 kHz in the present exemplary embodiment. However, the range may be, for example, in the range of 10 to 500 kHz. When the magnetic flux generated by the excitation coil 65*b* passes through the electroconductive layer 61*b* of the fixing belt 61, magnetic flux that counteracts a change in the magnetic flux is generated in the electroconductive layer 61*b* of the fixing belt 61, whereby an eddy current is generated in the electroconductive layer 61*b*. In the electroconductive layer 61*b*, the eddy current (I) generates a Joule heat ($W=I^2R$), which is proportional to the skin resistance (R) of the electroconductive layer 61*b*, whereby the fixing belt 61 is heated. At this time, the controller 40 (see FIG. 1) of the image forming apparatus controls the electric power or the time during which the high-frequency current is supplied to the excitation coil 65*b* on the basis of the temperature detected by the thermistor 70. Thus, the temperature of the fixing belt 61 is maintained at a predetermined level.

When the image forming apparatus according to the present exemplary embodiment starts an operation of forming a toner image, electric power is supplied to the induction heater 65 and the driving motor 68 for driving the fixing belt 61, whereby the fixing unit 60 is activated. Then, the fixing belt 61 rotates. At this time, the pressure roller 62 is separated from the fixing belt 61 by the latch mechanism 69. When the fixing belt 61 passes a heating region in which the fixing belt 61 faces the induction heater 65, an eddy current is induced in the electroconductive layer 61*b* of the fixing belt 61, whereby the fixing belt 61 is heated. Subsequently, the latch mechanism 69 makes the outer peripheral surface of the pressure roller 62 contact the fixing belt 61 at a predetermined timing. Then, the pressure roller 62 is rotated by the fixing belt 61. The timing at which the pressure roller 62 contacts the fixing belt 61 will be described below.

When the fixing belt 61 is heated to a predetermined temperature, a sheet S, on which an unfixed toner image has been formed, is fed into (enters) a fixing nip N (which is an example of a contact section) in which the fixing belt 61 and the pressure roller 62 contact each other. In the fixing nip N, the sheet S and the toner image formed on the sheet S are heated by the fixing belt 61 and are pressed by the fixing belt 61 and the pressure roller 62, which is an example of a pressure member, whereby the toner image is fixed on the sheet S. Subsequently, the sheet S is peeled off the fixing belt 61 due to a change in the curvature of the fixing belt 61, and transported to a sheet stacker (not shown) provided in an output unit of the image forming apparatus. A peel-off assist member 75, which is used to peel off the sheet S from the fixing belt 61 after fixing has been finished, may be disposed downstream of the fixing nip N.

In the fixing unit 60 according to the present exemplary embodiment, because the heat capacity of the fixing belt 61 is very low, the fixing belt 61 is heated in a short time, whereby warm-up time is significantly is extremely short. The fixing unit 60 has a good on-demand performance, so that consumption of standby power is reduced. Due to the pressure pad 63, the nip between the fixing belt 61 and the pressure roller 62 has a large width, whereby heat is smoothly transferred from the fixing belt 61 to the sheet S. Therefore, the fixing unit 60 has a high fixing performance.

The operation of pressing the pressure roller 62 against the fixing belt 61 and separating the pressure roller 62 from the fixing belt 61 will be described in detail.

Figure 5:
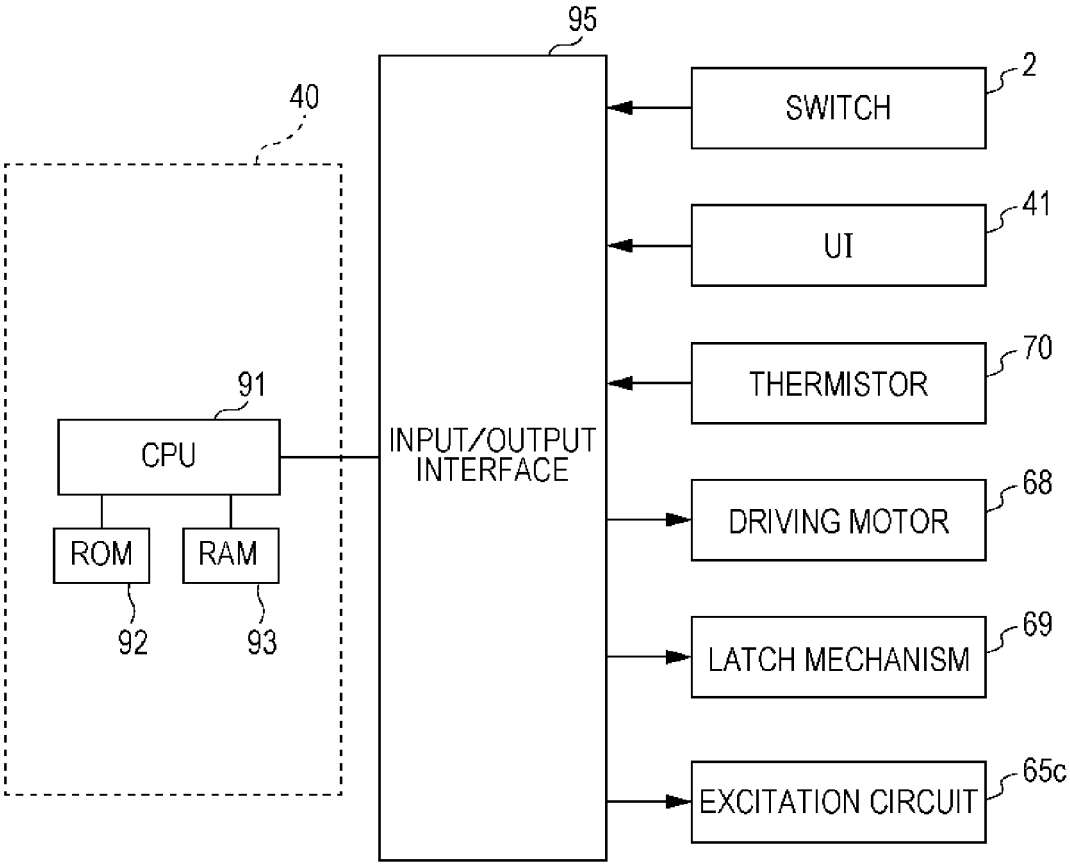
FIG. 5 is a block diagram of a controller.

FIG. 5 is a block diagram of the controller 40 illustrated in FIG. 1. Although the controller 40 has a function of controlling the entirety of the image forming apparatus, only the blocks related to the operation of the fixing unit 60 are illustrated in FIG. 5.

A central processing unit (CPU) 91 of the controller 40 performs processing in accordance with a program stored in a read only memory (ROM) 92 while sending data to and receiving data from a random access memory (RAM) 93. Power-on information from the switch 2, operation information from the UI 41, and temperature information from the thermistor 70 are input to the controller 40 through an input/output interface 95. On the other hand, the controller 40 outputs control signals to the driving motor 68 for driving the fixing belt 61, to the latch mechanism 69 for pressing the pressure roller against the fixing belt 61 and separating the pressure roller from the fixing belt 61, and to the excitation circuit 65*c* through the input/output interface 95.

Figure 6:
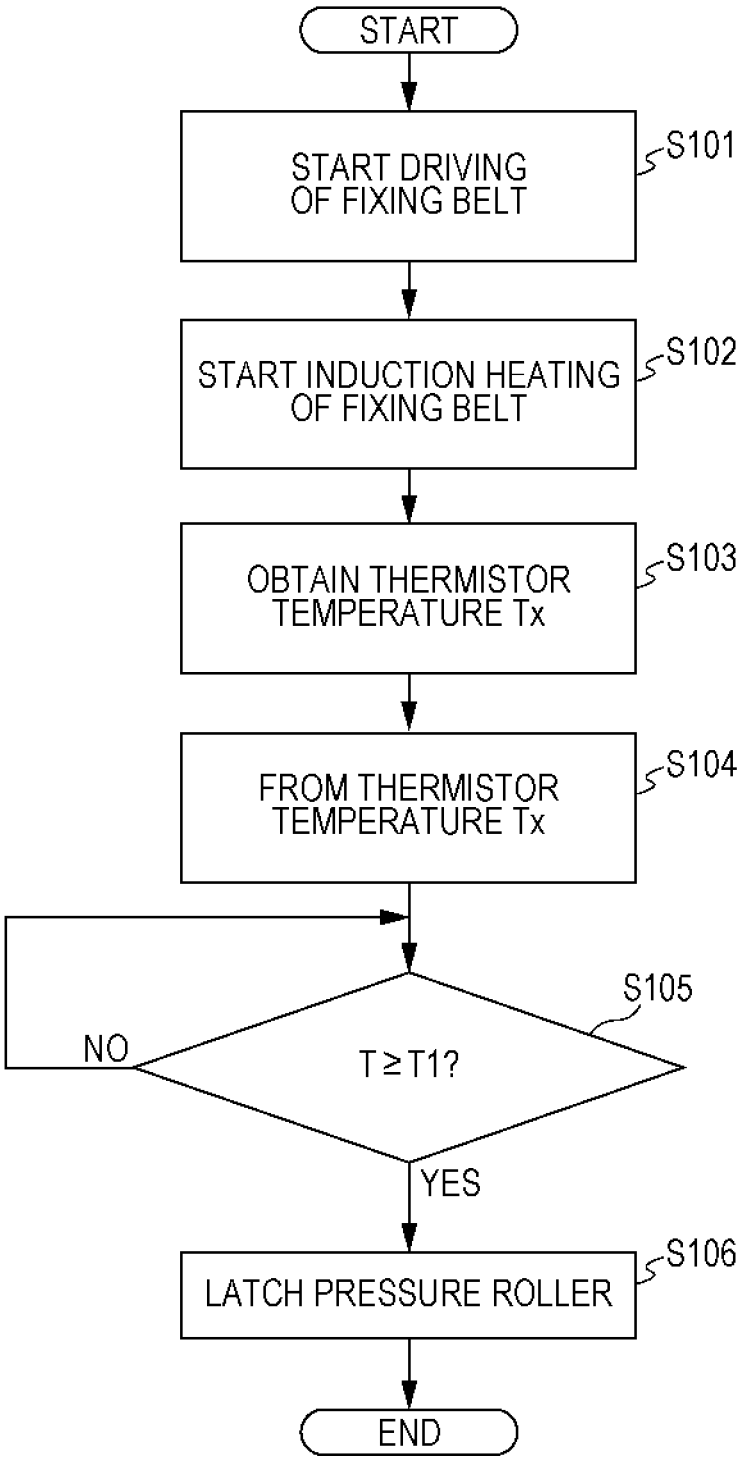
FIG. 6 is a flowchart of a process performed by the controller during a fixing operation.

FIG. 6 is a flowchart of a process performed by the controller 40 during a fixing operation.

In the present exemplary embodiment, when the switch 2 is operated and power is turned on, the controller 40 outputs a control signal to the driving motor 68 and starts to drive the fixing belt 61 (step S101). The controller 40 outputs a control signal also to the excitation circuit 65*c* and starts to heat the fixing belt 61 by induction by supplying a high-frequency current to the excitation coil 65*b* (step S102). Next, the controller 40 obtains a thermistor temperature Tx, which is a temperature measured by the thermistor 70 (step S103), and obtains a fixing belt temperature T, which is the surface temperature of the fixing belt 61, on the basis of the thermistor temperature Tx (step S104).

The controller 40 determines whether or not the fixing belt temperature T obtained in step S104 is equal to or higher than a predetermined set temperature T1 (step S105). In the present exemplary embodiment, the set temperature T1 is the lower limit of the temperature range that is suitable for fixing a toner image on a sheet S with the fixing unit 60. If it is determined that the temperature of the fixing belt is equal to or higher than the set temperature T1, the controller 40 outputs a control signal to the latch mechanism 69 to make the pressure roller 62 latch onto (contact) the fixing belt 61 (step S106). Then, the sheet S passes the fixing nip N, and the toner image is fixed on the sheet S. Because the pressure roller 62 contacts the fixing belt 61 due to the latching performed in step S106, the temperature of the pressure roller 62 increases.

In the fixing unit 60 according to the present exemplary embodiment, the fixing belt 61 is rotated while the fixing belt 61 is separated from the pressure roller 62 during warm-up, and the fixing belt 61 is heated by induction. When the temperature of the fixing belt 61 reaches a predetermined set temperature, the pressure roller 62 is made to contact the fixing belt 61. Thus, the pressure roller 62 does not take heat away from the fixing belt 61 during warm-up, whereby the temperature of the fixing belt 61 increases rapidly. Therefore, the warm-up time of the fixing unit 60 is shortened. With such a structure, the fixing unit 60 becomes operable in a short time, so that waiting time for a user is reduced. Moreover, in the present exemplary embodiment, it is not necessary to heat the fixing belt 61 beforehand, so that standby electric power is reduced.

Figure 7:
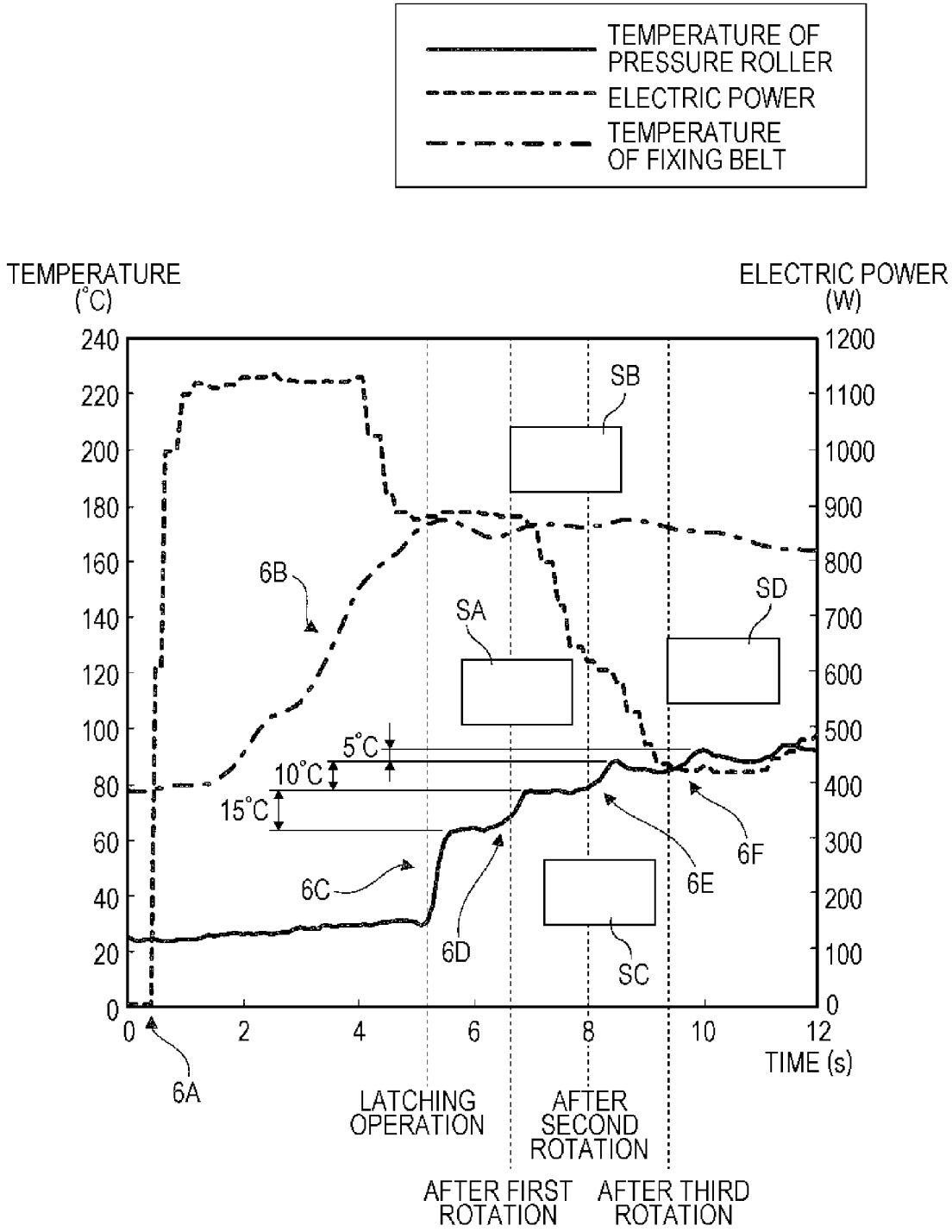
FIG. 7 is a graph illustrating the temperature of a pressure roller.

FIG. 7 is a graph illustrating the temperature of the pressure roller 62. In FIG. 7, the temperature of the pressure roller 62 is represented by a solid line. The solid line of FIG. 7 indicates a change in the temperature of a predetermined portion (hereinafter referred to as "specific portion") of the surface of the pressure roller 62. In FIG. 7, power consumption of the fixing unit 60 is represented by a broken line, and the temperature of the fixing belt 61 is represented by an alternate long and short dash line.

In the present exemplary embodiment, the pressure roller 62 is not heated and the fixing belt 61 is heated by the induction heater 65 during warm-up. To be specific, in a state in which the pressure roller 62 is separated from the fixing belt 61 by the latch mechanism 69, an eddy current is induced in the electroconductive layer 61*b* of the fixing belt 61, whereby the fixing belt 61 is heated. Subsequently, the latch mechanism 69 makes the pressure roller 62 contact the fixing belt 61. Then, the heat is transferred from the fixing belt 61 to the pressure roller 62.

Referring to FIG. 7, when electric power is started to be supplied to the fixing unit 60 as indicated by numeral 6A, the temperature of the fixing belt 61 increases as illustrated by numeral 6B in accordance with the supply of electric power. Then, in the present exemplary embodiment, as described above, when the temperature of the fixing belt 61 becomes equal to or higher than the set temperature T1, the controller 40 drives the latch mechanism 69 and the pressure roller 62 contacts the fixing belt 61. Thus, heat is transferred from the fixing belt 61 to the specific portion of the pressure roller 62 in the fixing nip N, and the temperature of the specific portion increases as represented by numeral 6C. When the first rotation of the pressure roller 62 finishes, the specific portion reaches the fixing nip N again, and the temperature of the specific portion has increased by about 15° C. (see numeral 6D).

Likewise, when the second rotation of the pressure roller 62 finishes, the specific portion reaches the fixing nip N again, and the temperature of the specific portion has increased by about 10° C. (see numeral 6E). Moreover, when the third rotation of the pressure roller 62 finishes, the specific portion reaches the fixing nip N again, and the temperature of the specific portion has increased by about 5° C. (see numeral 6F). As the number of rotations of the pressure roller 62 increases, the temperature of the specific portion approaches the temperature of the fixing belt 61. Therefore, the rate of increase in the temperature of the specific portion when the specific portion passes the fixing nip N (the temperature after the specific portion has passed the fixing nip N/the temperature before the specific portion passes the fixing nip N) decreases as the number of rotations of the pressure roller 62 increases.

Figure 8A:
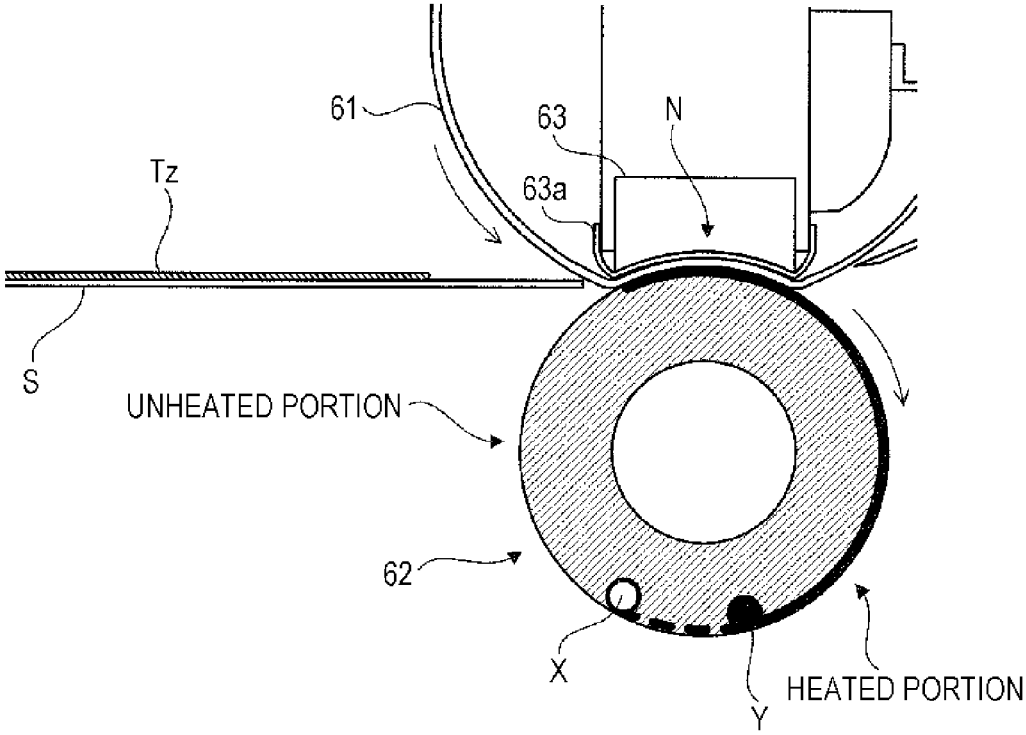
FIGS. 8A and 8B illustrate the temperature distribution of the pressure roller during the first rotation.
Figure 8B:
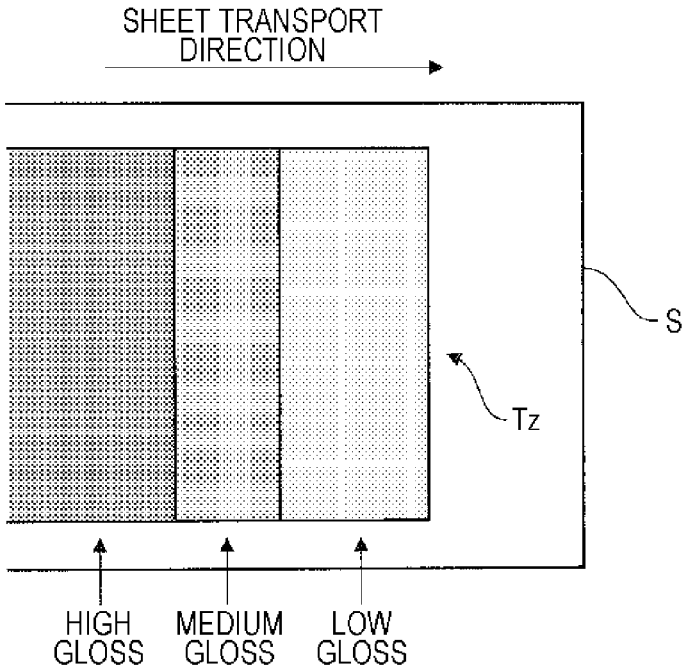

FIGS. 8A and 8B illustrate the temperature distribution of the pressure roller 62 during the first rotation of the pressure roller 62.

When the pressure roller 62 contacts the fixing belt 61, heat is transferred from the fixing belt 61 to the pressure roller 62. Therefore, as illustrated by a thick line in FIG. 8A, a heated portion is generated in a part of the surface the pressure roller 62 that is in contact with the fixing nip N and a part of the surface of the pressure roller 62 that has passed the fixing nip N while contacting the fixing nip N.

A white circle denoted by numeral X is a part of the surface of the pressure roller 62 that was at the exit of the fixing nip N (the downstream end of the fixing nip N) when the pressure roller 62 was made to contact the fixing belt 61 by the latch mechanism 69 (hereinafter this portion will be referred to as "downstream portion X"). In FIG. 8A, a black circle denoted by numeral Y is a part of the surface of the pressure roller 62 that was at the entrance of the fixing nip N (the upstream end of the fixing nip N) when the pressure roller 62 was made to contact the fixing belt 61 by the latch mechanism 69 (hereinafter this portion will be referred to as "upstream portion Y").

A part of the surface of the pressure roller 62 that is located downstream of the downstream portion X (downstream in the rotation direction of the pressure roller 62) is an unheated portion, which has not been heated by the fixing belt 61. Because the downstream portion X was in the fixing nip N for a very short time, the temperature of the downstream portion X is about the same as the unheated portion. On the other hand, because the upstream portion Y has passed almost all of the fixing nip N, the temperature of the upstream portion Y is as high as the temperature of the heated portion. Further, the surface temperature of the pressure roller 62 increases from the downstream portion X toward the upstream portion Y.

When the sheet S is transported to the fixing nip N in the state illustrated in FIG. 8A, the unheated portion of the pressure roller 62 contacts the leading end and the back side of the sheet S (which is opposite to the side on which a toner image is formed). That is, a part of the pressure roller 62 having a low temperature contacts the leading end and the back side of the sheet S. Subsequently, in the present exemplary embodiment, as the sheet S moves downstream, a region of the outer peripheral surface of the pressure roller 62 located between the downstream portion X and the upstream portion Y (hereinafter referred to as "interposed region") contacts the back side of the sheet S. In other words, a part of the pressure roller 62 having a relatively high temperature contacts the back side of the sheet S. Subsequently, the heated portion of the pressure roller 62 contacts the back side of the sheet S. In other words, a part of the pressure roller 62 having a higher temperature contacts the back side of the sheet S. The interposed region is a region of the outer peripheral surface of the pressure roller 62 that contacts the fixing belt 61 when the fixing belt 61 and the outer peripheral surface of the pressure roller 62 are made to contact each other by the latch mechanism 69 and that repeatedly reaches the fixing nip N as the pressure roller 62 rotates.

As a result, with the present exemplary embodiment, parts of a toner image Tz have different glosses as illustrated in FIG. 8B, i.e., the toner image Tz has a nonuniform gloss. To be specific, a part of the toner image Tz in a downstream area of the sheet S in the transport direction has a low gloss. More upstream an area of the sheet S, the higher the gloss of the toner image Tz formed on the area of the sheet S. To be specific, an area of the sheet S that contacts the unheated portion is supplied with a smaller amount of heat, so that the gloss of a part of the toner image Tz on the area is low. On the contrary, an area of the sheet S that contacts the heated portion of the pressure roller 62 is supplied with a larger amount of heat, so that a part of the toner image Tz on the area has a high gloss.

Figure 9A:
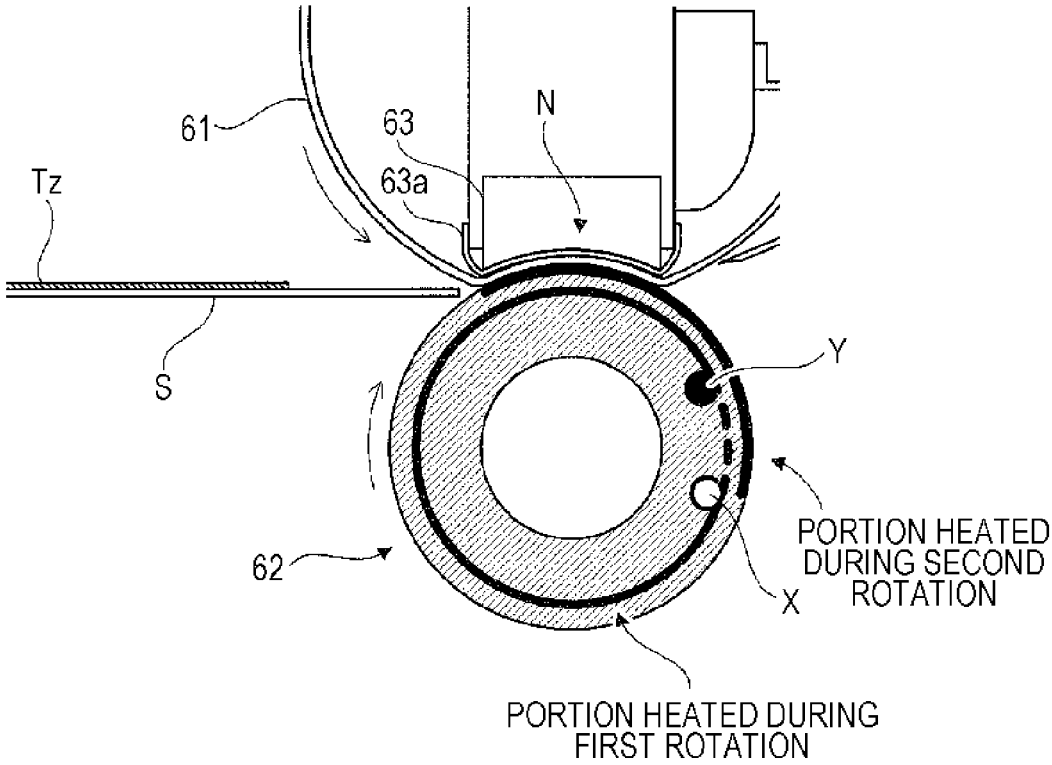
FIGS. 9A and 9B illustrate the state of the fixing unit after the pressure roller has started the second rotation.
Figure 9B:
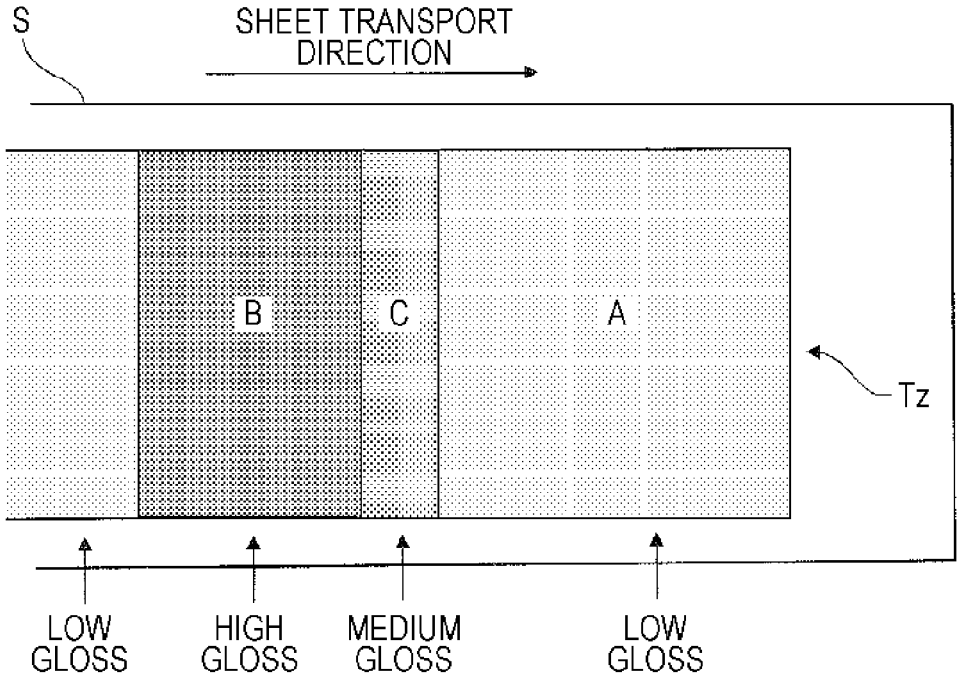

FIGS. 9A and 9B illustrate the state of the fixing unit 60 after the pressure roller 62 has started the second rotation.

In the above-described case, the sheet S is transported to the fixing nip N during the first rotation of the pressure roller 62. FIG. 9A illustrates a case where the sheet is transported to the fixing nip N after the pressure roller 62 has started the second rotation. In FIG. 9A, two thick lines are drawn in the pressure roller 62. The inner line represents a portion of the pressure roller 62 that was heated by the fixing belt 61 during the first rotation of the pressure roller 62. The outer line represents a portion of the pressure roller 62 that has been heated by the fixing belt 61 during the second rotation of the pressure roller 62. During the first rotation of the pressure roller 62, the entire periphery of the pressure roller 62 contacts the fixing belt 61, so that there is no unheated portion on the inner line.

If the sheet S enters the fixing nip N in the state illustrated in FIG. 9A, the pressure roller 62 contacts the back side of the sheet S as in the above-described case. In the case of FIG. 9A, a portion of the pressure roller 62 that has been heated once contacts the back side of the sheet S first. Subsequently, in the present exemplary embodiment, a portion of the pressure roller 62 that has been heated twice contacts the back side of the sheet S.

As a result, as shown in FIG. 9B, a region A of the toner image Tz located on the leading end side of the sheet S has a low gloss. A region B of the toner image Tz located on the trailing end side of the sheet S has a high gloss. That is, the toner image Tz has a nonuniform gloss (difference in gloss) also in this case. The temperature of the interposed region of the surface of the pressure roller 62, which is located between the downstream portion X and the upstream portion Y, increases from the downstream portion X toward the upstream portion Y even after the pressure roller 62 has been heated during the second rotation. Therefore, as shown in FIG. 9B, a region C of the toner image Tz between the region A and the region B has a medium gloss.

With the fixing unit 60 according to the present exemplary embodiment, as described above, parts of the toner image Tz have different glosses depending on the timing at which the sheet S enters the fixing nip N. To prevent this, in the present exemplary embodiment, the pressure roller 62 is made to contact the fixing belt 61 at a timing described below, thereby reducing the difference in gloss.

Figure 10:
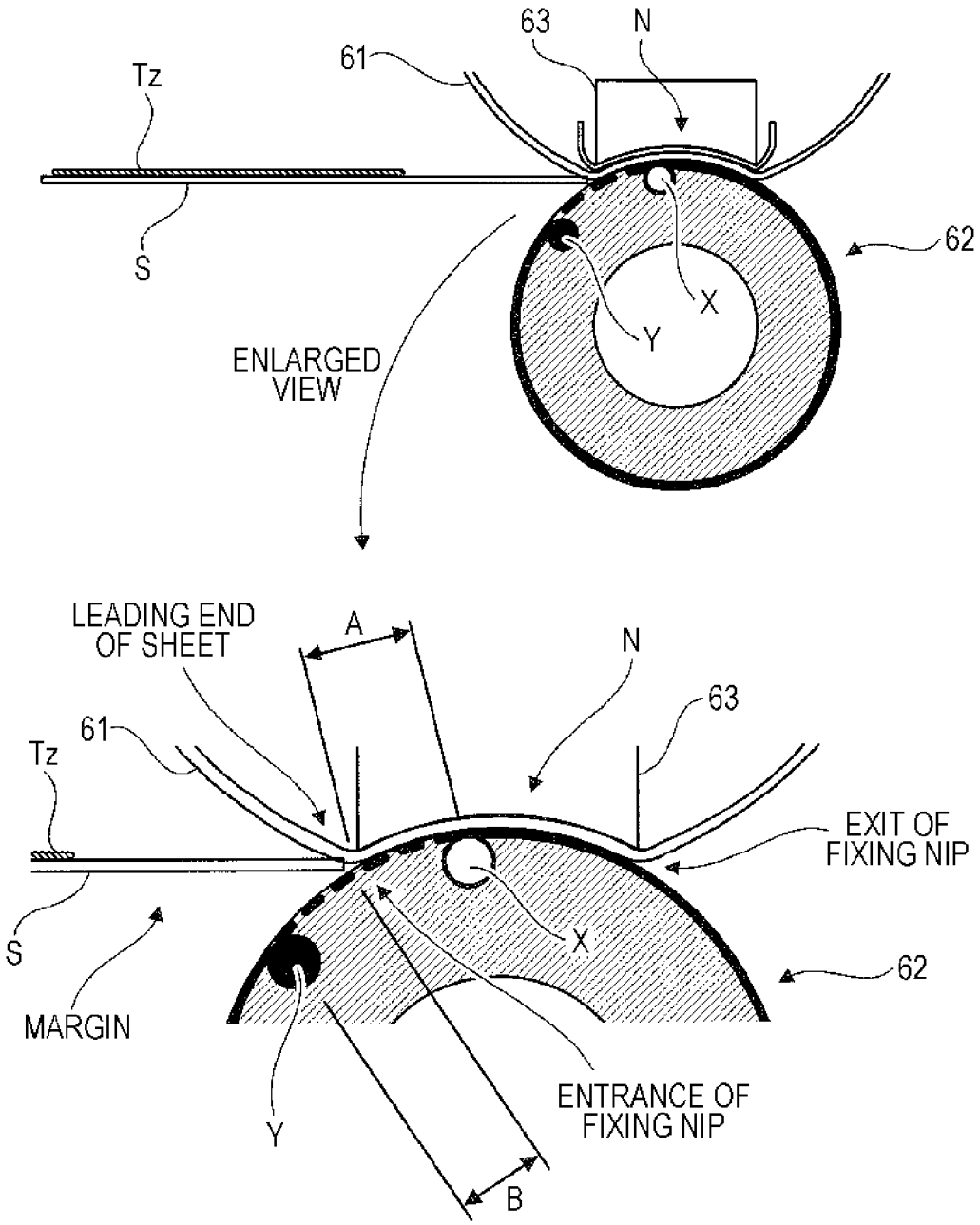
FIG. 10 illustrates a contact timing of the pressure roller according to the present exemplary embodiment.

FIG. 10 illustrates a contact timing of the pressure roller 62 according to the present exemplary embodiment.

In the present exemplary embodiment, the controller 40 knows the position of the sheet S in the image forming apparatus on the basis of an outputs of sensors (not shown) provided on a transport path of the sheet S. When the sheet S reaches a predetermined position, the controller 40 according to the present exemplary embodiment drives the latch mechanism 69 to make the pressure roller 62 contact the fixing belt 61. Thus, the pressure roller 62 starts rotating. Meanwhile, the sheet S is transported further and reaches the fixing nip N. In the present exemplary embodiment, as illustrated in FIG. 10, when the sheet S enters the fixing nip N, the leading end of the sheet S is positioned in (contacts) the interposed region between the downstream portion X and the upstream portion Y. In the image forming apparatus according to the present exemplary embodiment, the leading end of the sheet S is made to be positioned in the interposed region by adjusting (controlling) the timing at which the latch mechanism 69 is driven (i.e., the timing at which the pressure roller 62 is moved). Alternatively, the leading end of the sheet S may be made to be positioned in the interposed region by controlling the transport timing of the sheet S. To be specific, in the fixing unit 60 according to the present exemplary embodiment, the fixing belt 61 moves at a predetermined constant speed. Therefore, the period from the time at which the pressure roller 62 contacts the fixing belt 61 to the time at which the interposed region reaches the fixing nip N (the entrance of the fixing nip N) is constant. The transport speed of the sheet S is also predetermined, so that it is possible to calculate the distance that the sheet S moves during the period. Therefore, in the present exemplary embodiment, the latch mechanism 69 is driven and the pressure roller 62 is made to contact the fixing belt 61 when the sheet S reaches a predetermined position that is located upstream of the fixing nip N. Thus, the interposed region is formed on the pressure roller 62, and the interposed region moves downstream as the pressure roller 62 rotates. Then, as illustrated in FIG. 10, the interposed region reaches the fixing nip N at the same time as the leading end of the sheet S reaches the fixing nip N. In other words, the sheet S enters the fixing nip N when the interposed region reaches the fixing nip N. In this case, as illustrated in FIG. 10, the leading end of the sheet S contacts the interposed region.

In the case illustrated in FIG. 10, the entire peripheral surface of the pressure roller 62 contacts the fixing belt 61, whereby nonuniformity of the temperature of the surface of the pressure roller 62 is low. Therefore, with the present exemplary embodiment; nonuniformity of the gloss of the toner image Tz is low. To be precise, as illustrated in the enlarged view of FIG. 10 (see an arrow), a region A of the pressure roller 62 located between the downstream portion X and the fixing nip N contacts the fixing belt 61 twice. That is, the region A contacts the fixing belt 61 twice and is heated twice.

If the region A, which has been heated twice, contacts the sheet S as the pressure roller 62 rotates, a part of the toner image Tz that is heated by the region A may have a high gloss. However, as described above, the interposed region between the downstream portion X and the upstream portion Y contacts the fixing belt 61 only for a short time, so that the surface temperature of the interposed region is lower than that of other parts of the pressure roller 62. Therefore, although the region A is heated twice, an increase in the temperature of the region A is small. Accordingly, nonuniformity of the temperature of the pressure roller 62 is low, and nonuniformity of the gloss of the toner image Tz is low.

Even with the present exemplary embodiment, a part of the pressure roller 62 having a low temperature may contact the sheet S, and thereby a part of the toner image Tz may have a low gloss. As described above, a region B of the pressure roller 62 (see FIG. 10) between the upstream portion Y and the fixing nip N has a temperature lower than that of a part that is located further upstream of the upstream portion Y. Therefore, a part of the toner image Tz that is heated by the region B may have a low gloss. However, as illustrated in FIG. 10, a margin is usually provided at the leading end of the sheet S, and the toner image Tz is not formed in the margin. Therefore, the region B, which has a low temperature, contacts the margin of the sheet S, so that it is unlikely that the region B influences the toner image Tz. As a result, nonuniformity of the gloss of the toner image Tz is reduced also in this case.

Figure 11A:
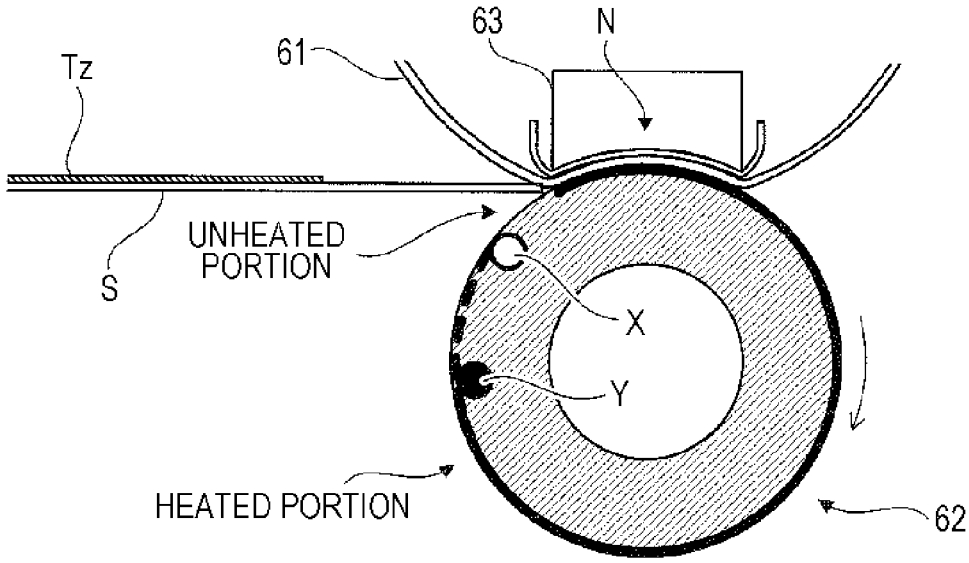
FIGS. 11A and 11B illustrate other states of the fixing unit.
Figure 11B:
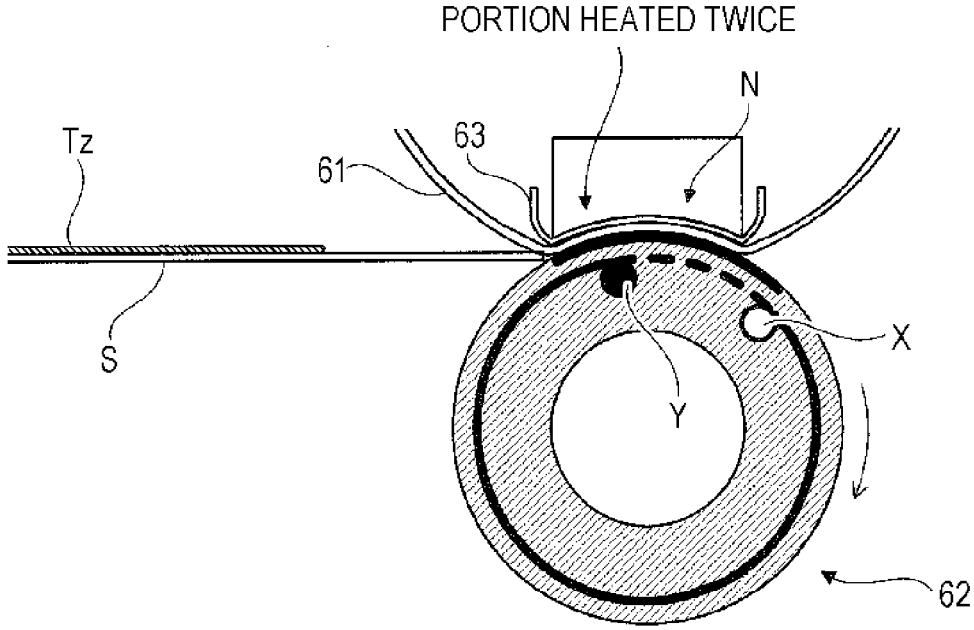

Referring to FIGS. 11A and 11B (illustrating the fixing unit 60 in another state), the fixing unit 60 will be described further. First, referring to FIG. 11A, a case where the leading end of the sheet S contacts a part of the pressure roller 62 that is located further downstream of the downstream portion X will be described. In other words, the leading end of the sheet S contacts a part of the pressure roller 62 that has not been heated by the fixing belt 61 (unheated portion). In this case, when the pressure roller 62 rotates once from the state illustrated in FIG. 11A, the unheated portion contacts the sheet S. In this case, the amount of heat transferred from the pressure roller 62 to the sheet S differs between the case where the unheated portion contacts the sheet S and the case where the heated portion contacts the sheet S, whereby the toner image Tz may have a nonuniform gloss. Therefore, in the exemplary embodiment described above, the fixing unit 60 is configured such that, when the sheet S enters the fixing nip N, the leading end of the sheet S contacts a part of the pressure roller 62 that is located upstream of the downstream portion X.

Referring to FIG. 11B, a case where the leading end of the sheet S contacts a part of the pressure roller 62 that is located further upstream of the upstream portion Y will be described. In this case, as illustrated in FIG. 11B, a portion (potion heated twice) of the pressure roller 62 between the upstream portion Y and a portion contacted by the leading end of the sheet S is heated twice by the fixing belt 61. In this case, when the pressure roller 62 rotates once from the state illustrated in FIG. 11A, the twice-heated portion contacts the sheet S. In this case, the amount of heat transferred from the pressure roller 62 to the sheet S differs between the case where the twice-heated portion contacts the sheet S and the case where another portion (portion heated once) contacts the sheet S, whereby the toner image Tz may have a nonuniform gloss as described above. Therefore, in the exemplary embodiment described above, the fixing unit 60 is configured such that, when the sheet S enters the fixing nip N, the leading end of the sheet S contacts a part of the pressure roller 62 that is located downstream of the upstream portion Y.

Figure 12:
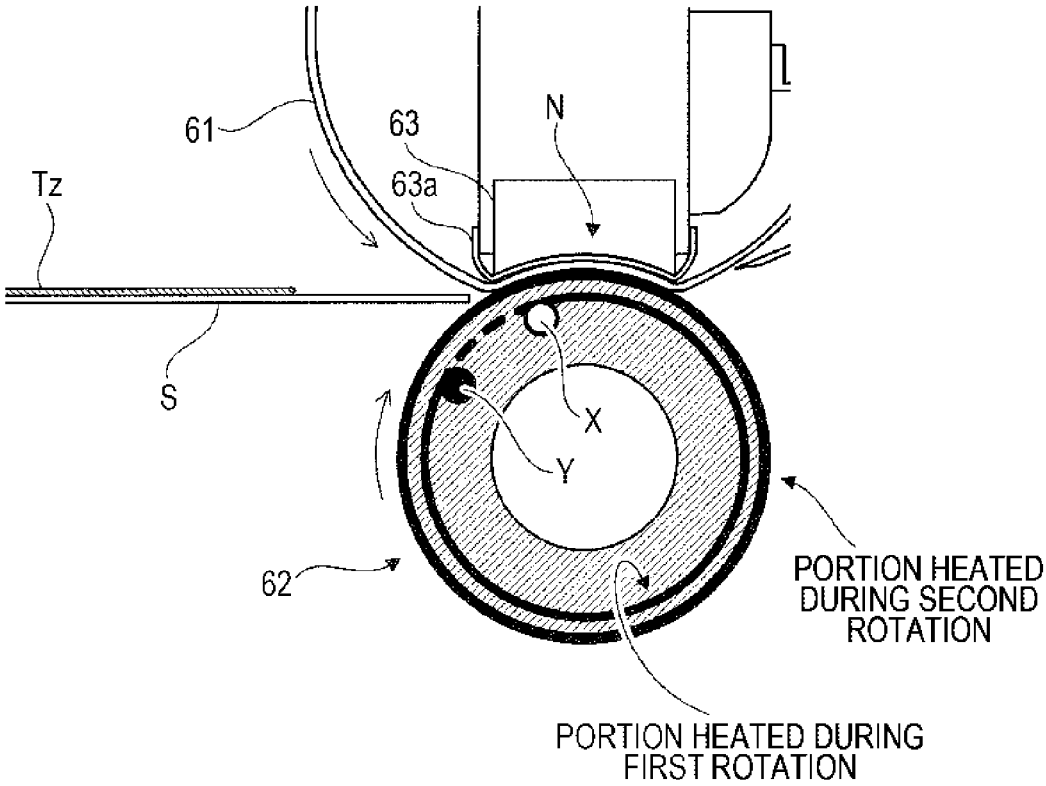
FIG. 12 illustrates another state of the fixing unit.

In the case described above, the sheet S reaches the fixing nip N when the first rotation of the pressure roller 62 is finished. However, as illustrated in FIG. 12 (illustrating another state of the fixing unit 60), the sheet S may reach the fixing nip N when the second rotation of the pressure roller 62 is finished. As a further alternative, the sheet S may reach the fixing nip N, instead of when the second rotation is finished, the third or fourth rotation of the pressure roller 62 is finished. Furthermore, the sheet S may reach the fixing nip N when the N-th rotation of the pressure roller 62 is finished (where N is an integer).

Although not described above, in FIG. 7, the numeral SB denotes a sheet S that reaches the fixing nip N when the first rotation of the pressure roller 62 is finished. The numeral SD denotes a sheet S that reaches the fixing nip N when the third rotation of the pressure roller 62 is finished. In these cases, the toner image Tz has a substantially uniform gloss as described above. The numeral SA in FIG. 7 denotes a sheet S that reaches the fixing nip N during the first rotation of the pressure roller 62. The numeral SC denotes a sheet S that reaches the fixing nip N during the second rotation of the pressure roller 62. In these cases, as described above, the pressure roller 62 has a non-uniform temperature, and the toner image Tz has a non-uniform gloss.

In the exemplary embodiment described above, the pressure roller 62 is made to contact the fixing belt 61 during a warm-up operation when the power is turned on. Such a warm-up operation is performed not only when the power is turned on but also when, for example, when a user open a platen cover (not shown) of an image reading apparatus (not shown), when a document is set on an automatic document feeder (not shown) of the image reading apparatus, and when a print signal is received from a PC (not shown).

In the exemplary embodiment described above, the fixing belt 61 is heated by the induction heater 65. However, this is not limited thereto. For example, only a part of the fixing belt 61 may be heated by providing a ceramic heater inside the fixing belt 61. In the present exemplary embodiment, the fixing unit 60 has the fixing belt 61. Instead of the fixing belt 61, a roller-like member may be used. Such a roller-like member may be heated by a heating roller that is disposed so as to be in contact with the outer peripheral surface of the roller-like member or by a heater disposed inside the roller-like member. In the present exemplary embodiment, the pressure roller 62 is made to be in contact with and separated from the fixing belt 61. However, this is not limited thereto, and the fixing belt 61 may be made to be in contact with and separated from the pressure roller 62.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming unit that forms an image on a recording medium;

a fixing unit that heats the recording medium transported from the image forming unit and fixes the image on the recording medium;

a pressure member that is rotatable and has an outer peripheral surface, the pressure member moving relative to the fixing unit from a position at which the pressure member is separated from the fixing unit to a position at which the outer peripheral surface contacts the fixing unit, the pressure member pressing the recording medium while rotating when the recording medium enters a contact section between the fixing unit and the outer peripheral surface; and a controller that controls transportation of the recording medium and a time at which a region of the outer peripheral surface reaches the contact section, the region contacting the fixing unit when the fixing unit contacts the outer peripheral surface and repeatedly reaching the contact section as the pressure member rotates, so that the recording medium that has been transported enters the contact section when the region reaches the contact section as the pressure member rotates, wherein the outer peripheral surface comprises an interposed region which initially contacts the fixing unit when the pressure member moves to the position at which the outer peripheral surface contacts the fixing unit, and wherein the controller controls transportation of the recording medium such that the recording medium enters the contact section, after the pressure member rotates thereby causing the interposed region to be temporarily separated from the fixing unit, and when the interposed region thereafter contacts the fixing unit again.

2. The image forming apparatus according to claim 1, wherein the controller controls the transportation of the recording medium and the time at which the region reaches the contact section so that a leading end of the recording medium that has been transported contacts the region in the contact section.

3. The image forming apparatus according to claim 1, wherein the pressure member rotates at a predetermined speed after contacting the fixing unit, and wherein the controller controls the time at which the region reaches the contact section by controlling a contact timing at which the pressure member contacts the fixing unit.

4. The image forming apparatus according to claim 2, wherein the pressure member rotates at a predetermined speed after contacting the fixing unit, and wherein the controller controls the time at which the region reaches the contact section by controlling a contact timing at which the pressure member contacts the fixing unit.

5. The image forming apparatus according to claim 1, wherein the interposed region is a region of the pressure member which is initially heated when the fixing unit initially contacts the pressure member.

6. The image forming apparatus according to claim 5, wherein the interposed region is between an unheated portion of the pressure member and a fully heated portion of the pressure member, during a first rotation of the pressure member, after the pressure member moves to the position at which the outer peripheral surface contacts the fixing unit.

7. The image forming apparatus according to claim 6, wherein the controller controls transportation of the recording medium such that a toner image of the recording medium always enters the contact section at the fully heated portion of the pressure member, and the toner image of the recording medium never enters the contact section at any portion of the pressure member that has not been fully heated.

8. An image forming apparatus comprising:

an image forming unit that forms an image on a recording medium;

a fixing unit that heats the recording medium transported from the image forming unit and fixes the image on the recording medium;

a pressure member that is rotatable and has an outer peripheral surface, the pressure member moving, when a temperature of the fixing unit reaches a predetermined temperature, relative to the fixing unit from a position at which the pressure member is separated from the fixing unit to a position at which the outer peripheral surface contacts the fixing unit, the pressure member pressing the recording medium while rotating when the recording medium enters a contact section between the fixing unit and the outer peripheral surface; and a controller that controls transportation of the recording medium and a reaching time at which a region of the outer peripheral surface reaches the contact section, the region contacting the fixing unit when the fixing unit contacts the outer peripheral surface and repeatedly reaching the contact section as the pressure member rotates, so that the recording medium that has been transported enters the contact section when the region reaches the contact section as the pressure member rotates, wherein the outer peripheral surface comprises an interposed region which initially contacts the fixing unit when the pressure member moves to the position at which the outer peripheral surface contacts the fixing unit, and wherein the controller controls transportation of the recording medium such that the recording medium enters the contact section, after the pressure member rotates thereby causing the interposed region to be temporarily separated from the fixing unit, and when the interposed region thereafter contacts the fixing unit again.

9. An image forming apparatus comprising:

an image forming unit that forms an image on a recording medium;

a fixing unit that rotates at a predetermined speed and heats the recording medium transported from the image forming unit and fixes the image on the recording medium;

a pressure member that is rotatable and has an outer peripheral surface, the pressure member moving relative to the fixing unit from a position at which the pressure member is separated from the fixing unit to a position at which the outer peripheral surface contacts the fixing unit and the pressure member starts rotating by receiving a driving force from the fixing unit, the pressure member pressing the recording medium while rotating when the recording medium enters a contact section between the fixing unit and the outer peripheral surface; and a controller that controls a time at which the pressure member moves relative to the fixing unit, wherein a region of the outer peripheral surface that contacts the fixing member when the fixing member contacts the outer peripheral surface repeatedly reaches the contact section as the pressure member rotates, and wherein the controller controls the time at which the pressure member moves relative to the fixing unit so that the region reaches the contact section when the recording sheet that has been transported enters the contact section, wherein the outer peripheral surface comprises an interposed region which initially contacts the fixing unit when the pressure member moves to the position at which the outer peripheral surface contacts the fixing unit, and wherein the controller controls transportation of the recording medium such that the recording medium enters the contact section, after the pressure member rotates thereby causing the interposed region to be temporarily separated from the fixing unit, and when the interposed region thereafter contacts the fixing unit again.

10. The image forming apparatus according to claim 9, wherein the controller controls the time at which the pressing member moves relative to the fixing member so that a leading end of the recording medium that has been transported contacts the region in the contact section.

* * * * *